US007563140B1

(12) United States Patent
Wan et al.

(10) Patent No.: US 7,563,140 B1
(45) Date of Patent: Jul. 21, 2009

(54) PLUG CONNECTOR

(75) Inventors: Wei Wan, HsinTien (TW); Shu Lin Duan, HsinTien (TW); Ching Tien Chen, HsinTien (TW); Pin Yuan Hou, HsinTien (TW); Wen Chih Ko, HsinTien (TW)

(73) Assignee: Advanced-Connectek Inc., Taipei County (TW)

( * ) Notice: Subject to any disclaimer, the term of this patent is extended or adjusted under 35 U.S.C. 154(b) by 0 days.

(21) Appl. No.: 12/358,490

(22) Filed: Jan. 23, 2009

(51) Int. Cl.
*H01R 24/00* (2006.01)

(52) U.S. Cl. ..... 439/660

(58) Field of Classification Search ..... 439/660, 439/607, 677
See application file for complete search history.

(56) References Cited

U.S. PATENT DOCUMENTS 6,309,255 B1 * 10/2001 Yu ..... 439/660
7,128,617 B2 * 10/2006 Wang et al. ..... 439/660
7,155,545 B1 * 12/2006 Wang ..... 710/72
7,232,346 B2 * 6/2007 Hu et al. ..... 439/660
7,354,314 B1 * 4/2008 Sprouse et al. ..... 439/660

* cited by examiner

*Primary Examiner*—Phuong K Dinh
(74) *Attorney, Agent, or Firm*—Rabin & Berdo, P.C.

(57) ABSTRACT

A plug connector in accordance with the present invention comprises a first subassembly, a second subassembly and a casing. The first subassembly comprises a mounting frame and four first contact pins. The first contact pins comply with a USB 2.0 specification and are insert-molded in the mounting frame to form the first subassembly. The second subassembly is connected to the first subassembly and comprises a mounting frame and five second contact pins. The second contact pins comply with a USB 3.0 specification, are mounted in the mounting frame to form the second subassembly and are staggered with the first contact pins after the first subassembly and second subassembly are connected. The casing covers the first subassembly and the second subassembly.

5 Claims, 7 Drawing Sheets

PLUG CONNECTOR

FIELD OF THE INVENTION

A plug connector in accordance with the present invention complies with USB 2.0 and USB 3.0 specifications.

BACKGROUND OF THE INVENTION

A Universal Serial Bus (USB) is a serial bus standard to interface devices with a host computer. The USB was designed to allow many computer peripherals to be connected using a single standardized interface socket and to improve plug and play capabilities by allowing devices to be connected and disconnected without rebooting the computer and turning off the device.

Other convenient features of the USB include providing power to low-consumption devices without a separate external power supply and allowing many devices to be used without requiring manufacturer specific individual device drivers to be installed.

The USB is intended to substitude for serial ports and parallel ports and connects many computer peripherals such as mice, keyboards, PDAs, gamepads, joysticks, scanners, digital cameras, printers, personal media players and flash drives. For many of those devices, the USB has become a standard connection.

USB 2.0 is the most popular USB specification and supports high speed data transmission up to 480 Mbps. However, a more reliable connection technique with a higher transmission rate allows modern digital equipment to transmit greater amounts of data and operate closer to real-time. A USB 3.0 specification was developed to provide a higher data transfer rate than the USB 2.0 specification.

The USB 3.0 data transfer rate (4.8 Gbps) is ten times the USB 2.0 data transfer rate. The USB 3.0 specification is expected to upgrade data transfer efficiency of personal computers, consumer electronics and mobile devices but is not commonly used, yet. The USB 2.0 specification is the dominant USB specification. If the USB 2.0 and USB 3.0 specifications could be combined to form a new interface, the interface would have to comply with the USB 2.0 and USB 3.0 specifications and could be used simultaneously to meet consumers' current and emerging demands.

SUMMARY OF THE INVENTION

The objective of the present invention is to provide a plug connector that complies with USB 2.0 and 3.0 specifications.

A plug connector in accordance with the present invention comprises a first subassembly, a second subassembly and a casing. The first subassembly comprises a mounting frame and four first contact pins. The first contact pins comply with the USB 2.0 specification and are insert-molded in the mounting frame to form the first subassembly. The second subassembly is combined with the first subassembly and comprises a mounting frame and five second contact pins. The second contact pins comply with the USB 3.0 specification, are mounted in the mounting frame to form the second subassembly and are staggered with the first contact pins after the first subassembly and second subassembly are combined. The casing covers the first subassembly and the second subassembly.

DETAILED DESCRIPTION OF THE PRESENT INVENTION

Figure 1:
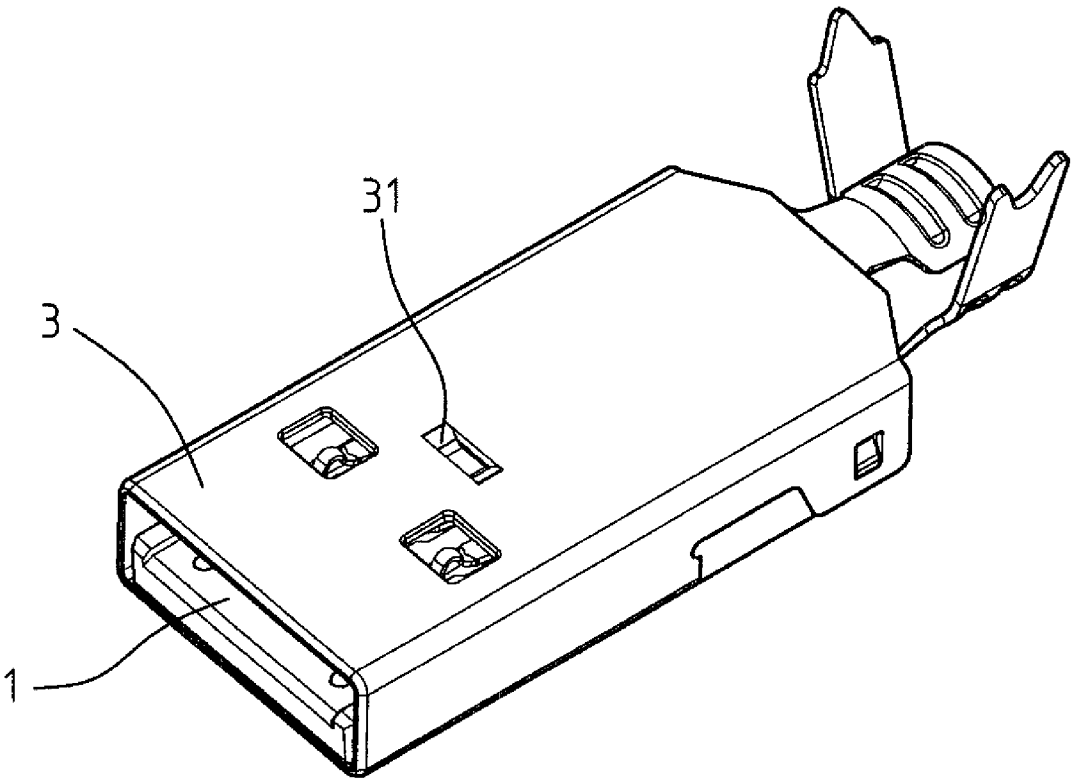
FIG. 1 is a perspective view of a plug connector in accordance with the present invention.
Figure 2:
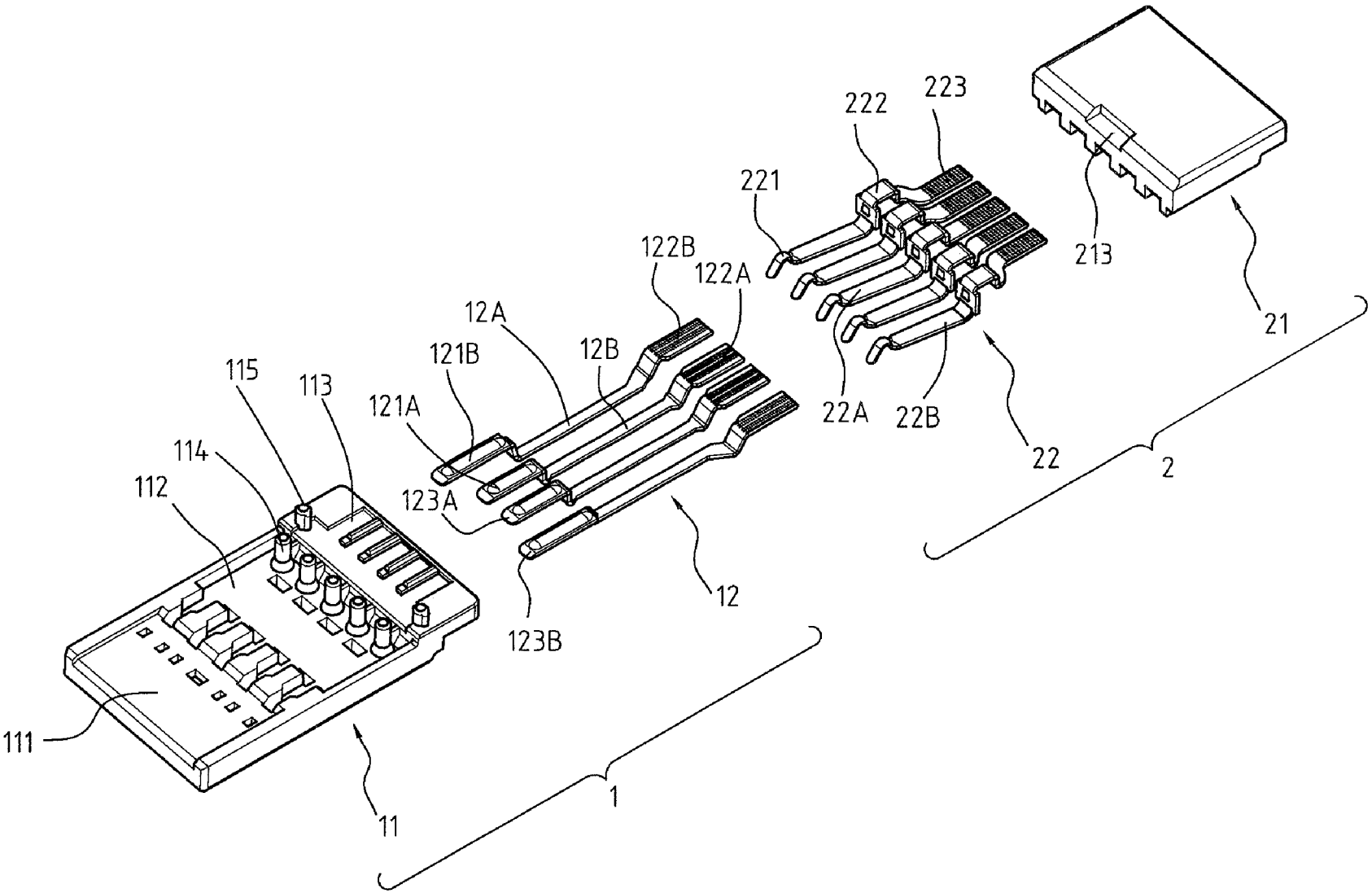
FIG. 2 is an exploded top perspective view of a first subassembly and a second subassembly of the plug connector in FIG. 1.

With reference to FIGS. 1 and 2, a plug connector in accordance with the present invention comprises a first subassembly (1), a second subassembly (2) and a casing (3).

The first subassembly (1) comprises a mounting frame (11) and four first contact pins (12).

Figure 3:
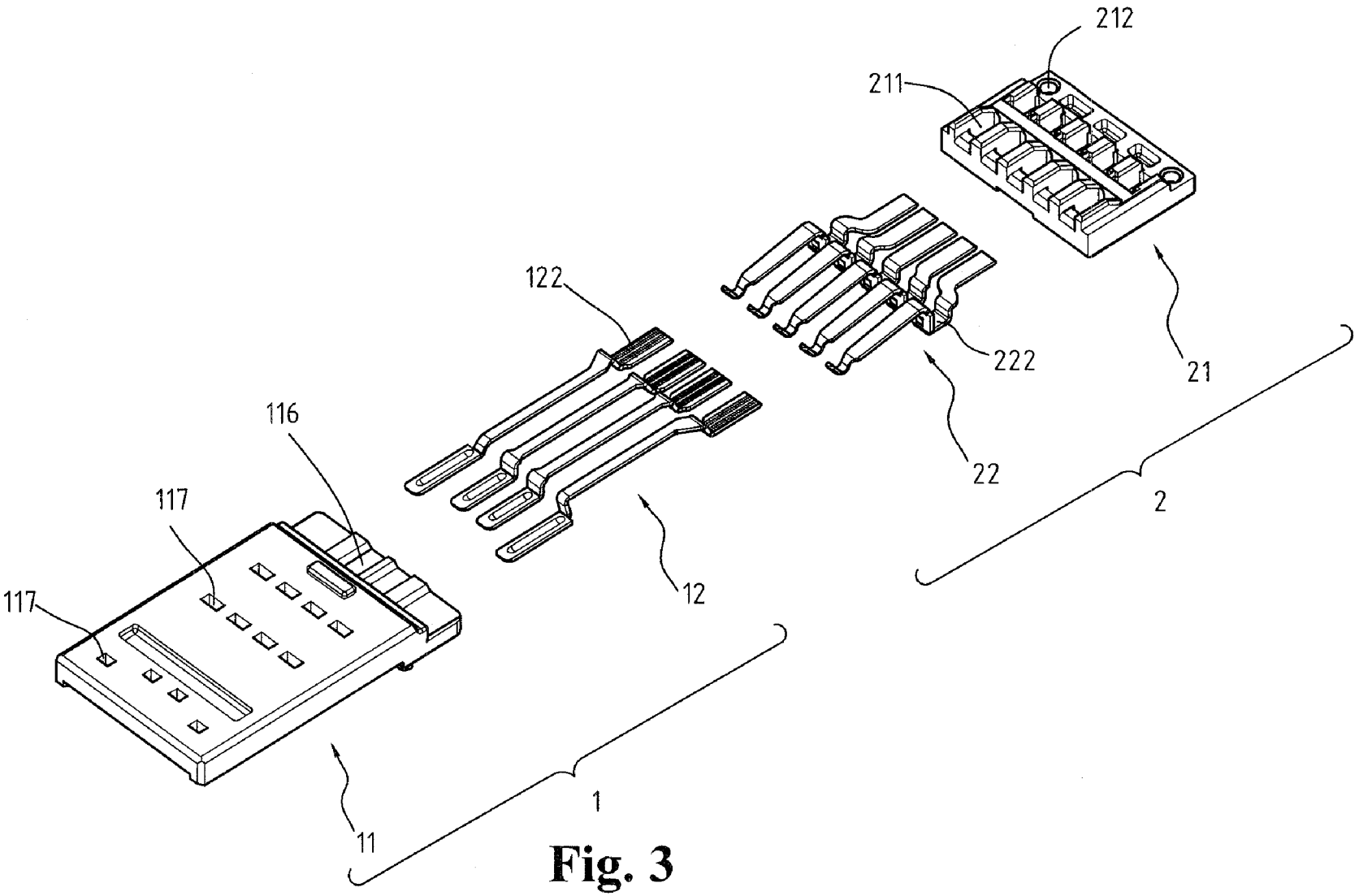
FIG. 3 is an exploded bottom perspective view of the first subassembly and the second subassembly in FIG. 2.
Figure 4:
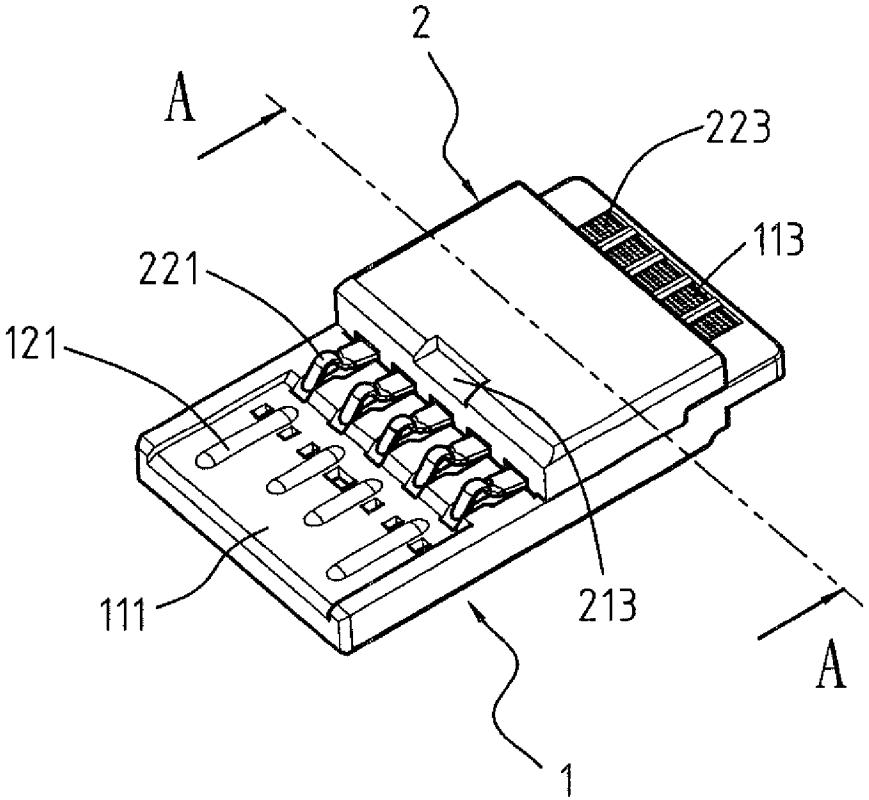
FIG. 4 is a top perspective view of the first subassembly and the second subassembly in FIG. 2.
Figure 5:
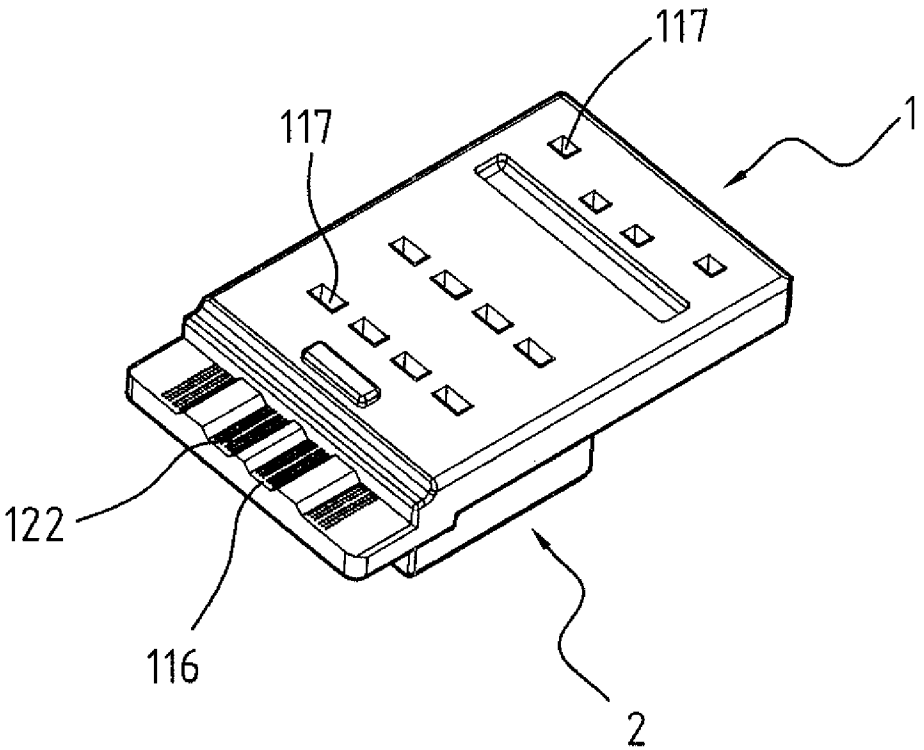
FIG. 5 is a bottom perspective view of the first subassembly and the second subassembly in FIG. 3.
Figure 6:
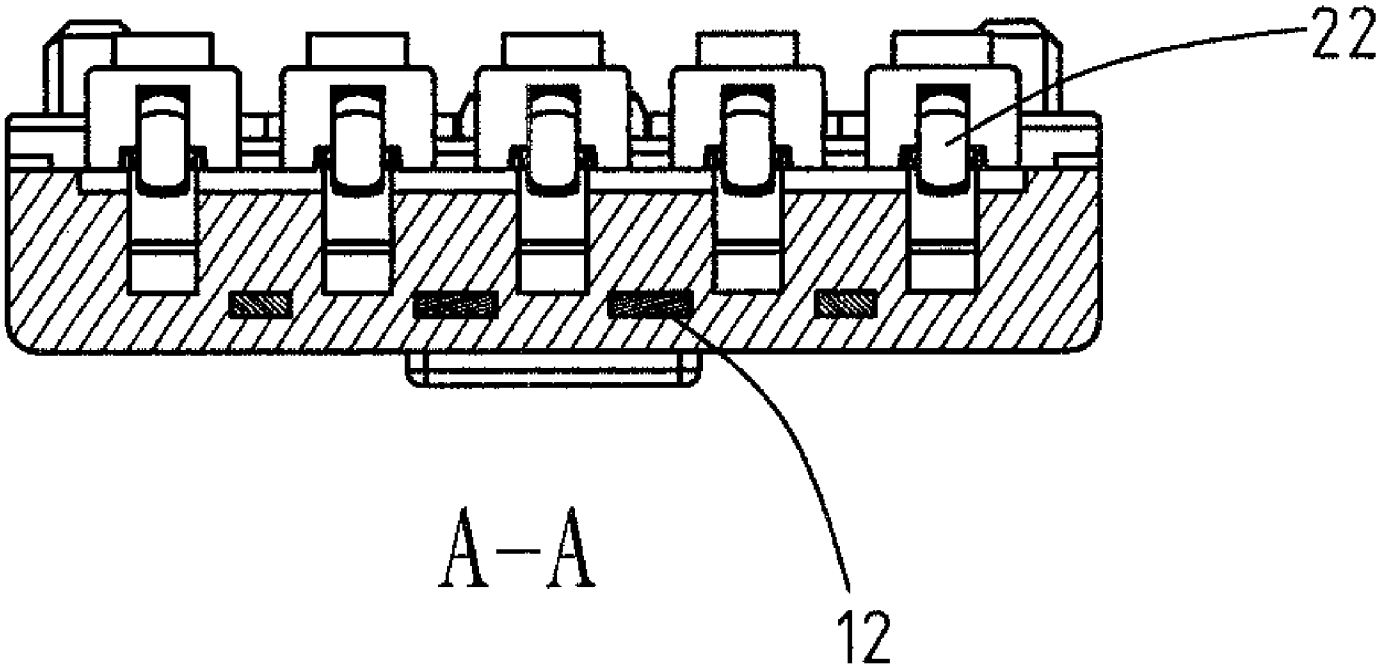
FIG. 6 is a front view in partial section of the first subassembly and the second subassembly along line A-A in FIG. 4.
Figure 7:
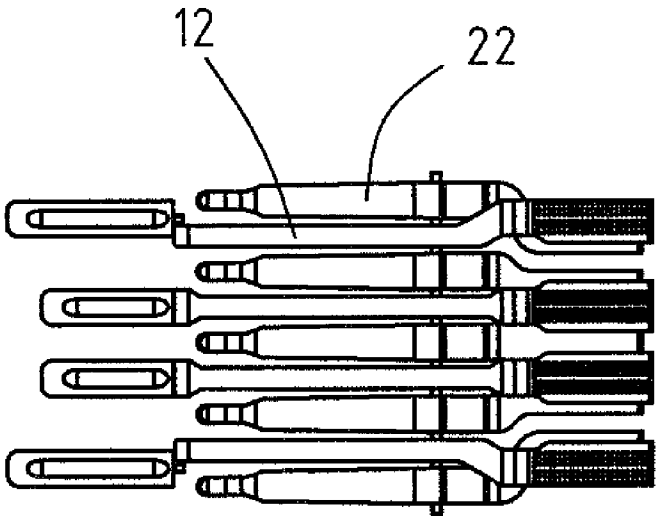
FIG. 7 is a top view of staggered first subassembly contact pins and second subassembly contact pins in FIG. 5.

With further reference to FIG. 3, the mounting frame (11) is an insulator and has a front end, a rear end, an inner surface, an outer surface, a front recess (111), a rear recess (113), a central transverse recess (112), at least one second contact pin support (114), multiple anchor protrusions (115), multiple recessed slots (116) and twelve optional mounting holes (117). The front recess (111) is formed on the inner surface near the front end. The rear recess (113) is formed on the inner surface near the rear end. The central transverse recess (112) is formed on the inner surface between the front recess (111) and the rear recess (113). The at least one second contact pin support (114) is formed on the central transverse recess (112) near the rear recess (113). The anchor protrusions (115) are formed on the rear recess (113) near the at least one second contact pin support (114). The recessed slots (116) are formed on the outer surface near the rear end. The optional mounting holes (117) are formed through the mounting frame (11).

The first contact pins (12) comply with a USB 2.0 specification, are insert-molded in the mounting frame (11) and comprise two central first contact pins (12A) and two outer first contact pins (12B).

The central first contact pins (12A) are U-shaped. Each central first contact pin (12A) has an upper surface, a lower surface, a longitudinal shaft, an offset socket contact (121A), and an offset wire contact (122A).

The longitudinal shaft has a front end and a rear end.

The offset socket contact (121A) is formed on the front end of the longitudinal shaft, protrudes transversely from the upper surface, bends, protrudes longitudinally from the longitudinal shaft, is mounted on the front recess (111) to connect to a video port connector and has an optional curved tip (123A). The curved tip (123A) is bent downward to embed in the front recess (111) to prevent the first contact pins (12A) from bending upward.

The offset wire contact (122A) is formed on the rear end of the longitudinal shaft, protrudes transversely from the upper surface, bends, protrudes longitudinally from the longitudinal shaft, is mounted on a corresponding recessed slot (116) on the outer surface, has nonskid on the upper and lower surfaces and connects to corresponding wires from a device to which the plug connector is connected. The nonskid on the two central first contact pins (12A) expands outward.

The outer first contact pins (12B) are U-shaped and are slightly longer than the central first contact pins (12A). Each outer first contact pin (12B) has an upper surface, a lower surface, a longitudinal shaft, an offset socket contact (121B), and an offset wire contact (122B).

The longitudinal shaft has a front end and a rear end.

The offset socket contact (121B) is formed on the front end of the longitudinal shaft, protrudes transversely from the upper surface, bends, protrudes longitudinally from the longitudinal shaft, is mounted on the front recess (111) to connect to a video port connector and has an optional curved tip (123B). The curved tip (123B) is bent downward to embed in the front recess (111) to prevent the outer first contact pins (12B) from bending upward.

The offset wire contact (122B) is formed on the rear end of the longitudinal shaft, protrudes transversely from the upper surface, bends, protrudes longitudinally from the longitudinal shaft, is mounted on a corresponding recessed slot (116) on the outer surface, has nonskid on the upper and lower surfaces and connects to corresponding wires from a device to which the plug connector is connected. The nonskid on the two outer first contact pins (12B) expands toward the central first contact pins (12A) to decrease distances between the nonskid of the four first contact pins (12) to keep the wires connecting respectively to the first contact pins (12) from separating to maintain efficiency of high frequency transmission.

The second subassembly (2) is connected to the first subassembly (1) and comprises a mounting frame (21) and five second contact pins (22).

The mounting frame (21) is an insulator and has a front end, a rear end, an outer surface, an inner surface, five contact pin seats (211), multiple anchor holes (212) and an optional detent (213). The contact pin seats (211) are formed on the inner surface. The anchor holes (212) are formed on the inner surface near the rear end and hold the anchor protrusions (115) to connect the first subassembly (1) and the second subassembly (2). The detent (213) is formed on the outer surface and front end.

The second contact pins (22) comply with a USB 3.0 specification, are mounted respectively in the contact pin seats (211) of the mounting frame (21) to form the second subassembly (2), are staggered with the first contact pins (12) and comprise one central second contact pin (22A) and four outer second contact pins (22B), and each second contact pin (22) has a front end, a resilient contact (221), a rear end, a protrusion (222), an upper nonskid surface (223). The front end is a hook and includes an upper surface and a lower surface. The resilient contact (221) is formed on the upper surface of the front end to connect to a video port connector. The rear end includes an upper surface and a lower surface and is on the rear recess (113) by the lower surface after the first subassembly (1) and the second subassembly (2) are connected. The protrusion (222) extends upward between the front and rear ends and is held in place by a corresponding second contact pin support (114) to prevent the second contact pin (22) from moving. The upper nonskid surface (223) is formed adjacent to the rear end. The upper nonskid surface (223) on the central second contact pin (22A) is linear. The upper nonskid surfaces (223) of the four outer second contact pins (22B) bend toward the central second contact pin (22A) to decrease distances between the upper nonskid surfaces (223) of the five second contact pins (22) to keep cables from separating and to maintain efficiency of high frequency transmission.

The casing (3) covers the first subassembly (1) and the second subassembly (2) and comprises an inner surface, an outer surface and an optional boss (31). The boss (31) is formed on the inner surface to press against the optional detent (213) to keep the assembled first subassembly (1) and the second subassembly (2) mounted correctly in the casing (3).

What is claimed is:

1. A plug connector comprising a first subassembly comprising a mounting frame being an insulator and having a front end;

a rear end;

an inner surface;

an outer surface;

a front recess being formed on the inner surface near the front end;

a rear recess being formed on the inner surface near the rear end;

a central transverse recess being formed on the inner surface between the front recess and the rear recess;

at least one second contact pin support being formed on the central transverse recess near the rear recess;

multiple anchor protrusions being formed on the rear recess near the at least one second contact pin support; and multiple recessed slots being formed on the outer surface near the rear end;

four first contact pins complying with a USB 2.0 specification, being insert-molded in the mounting frame and comprising two central first contact pins being U-shaped, and each first contact pin having an upper surface;

a lower surface;

a longitudinal shaft having a front end and a rear end;

an offset socket contact being formed on the front end of the longitudinal shaft, protruding transversely from the upper surface, bending, protruding longitudinally from the longitudinal shaft, being mounted on the front recess to connect to a video port connector; and an offset wire contact being formed on the rear end of the longitudinal shaft, protruding transversely from the upper surface, bending, protruding longitudinally from the longitudinal shaft, being mounted on a corresponding recessed slot on the outer surface, having nonskid on the upper and lower surfaces and connecting to corresponding wires from a device to which the plug connector is connected;

two outer first contact pins being U-shaped and being slightly longer than the central first contact pins, and each outer first contact pin (12B) having an upper surface;

a lower surface;

a longitudinal shaft having a front end and a rear end;

an offset socket contact being formed on the front end of the longitudinal shaft, protruding transversely from the upper surface, bending, protruding longitudinally from the longitudinal shaft, being mounted on the front recess to connect to a video port connector; and an offset wire contact being formed on the rear end of the longitudinal shaft, protruding transversely from the upper surface, bends, protruding longitudinally from the longitudinal shaft, being mounted on a corresponding recessed slot on the outer surface, having nonskid on the upper and lower surfaces, connecting to corresponding wires from a device to which the plug connector is connected and expanding toward the central first contact pins to decrease distances between the nonskid of the four first contact pins to keep the wires connecting respectively to the first contact pins from separating to maintain efficiency of high frequency transmission;

a second subassembly being connected to the first subassembly and comprising a mounting frame being an insulator and having a front end;

a rear end;

an outer surface;

an inner surface;

five contact pin seats being formed on the inner surface; and multiple anchor holes being formed on the inner surface near the rear end and holding the anchor protrusions to connect the first subassembly and the second subassembly;

five second contact pins complying with a USB 3.0 specification, being mounted respectively in the contact pin seats of the mounting frame to form the second subassembly, being staggered with the first contact pins, and comprising one central second contact pin and four outer second contact pins, and each second contact pin having a front end being a hook and including an upper surface and a lower surface;

a resilient contact being formed on the upper surface of the front end to connect to a video port connector;

a rear end including an upper surface and a lower surface and being on the rear recess by the lower surface after the first subassembly and the second subassembly are combined;

a protrusion extends upward between the front and rear ends and is held in place by a corresponding second contact pin support to prevent the second contact pin from moving; and an upper nonskid surface being formed adjacent to the rear end, and the upper nonskid surface on the central second contact pin is linear, and the upper nonskid surfaces of the four outer second contact pins bend toward the central second contact pin to decrease distances between the upper nonskid surfaces of the five second contact pins to keep cables from separating and to maintain efficiency of high frequency transmission;

a casing covering the first subassembly and the second subassembly and comprising an inner surface and an outer surface.

2. The plug connector as claimed as claim 1, wherein the mounting frame of the first subassembly further comprises multiple holes being formed through the mounting frame.

3. The plug connector as claimed as claim 1, wherein the offset socket contacts have curved tips to embed in the front recess to prevent the front ends of the first contact pins from bending upward.

4. The plug connector as claimed as claim 1, wherein the mounting frame of the second subassembly further comprises a detent being formed on the outer surface and front end.

5. The plug connector as claimed as claim 4, wherein the casing further comprises a boss being formed on the inner surface of the casing to press against the detent of the mounting frame to keep the assembled first subassembly and the second subassembly mounted correctly in the casing.

* * * * *